US008115417B2

(12) United States Patent
Zhang et al.

(10) Patent No.: US 8,115,417 B2
(45) Date of Patent: Feb. 14, 2012

(54) COLOR MANAGEMENT SYSTEM AND METHOD FOR LED BACKLIGHTS

(75) Inventors: Kailiang Zhang, Beijing (CN); Li Ma, Beijing (CN); Jingwei Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 474 days.

(21) Appl. No.: 12/276,175

(22) Filed: Nov. 21, 2008

(65) Prior Publication Data

US 2009/0134807 A1 May 28, 2009

(30) Foreign Application Priority Data

Nov. 23, 2007 (CN) ..... 2007 1 0178007

(51) Int. Cl.
*H05B 37/02* (2006.01)

(52) U.S. Cl. ..... 315/307; 315/157; 315/308; 315/312

(58) Field of Classification Search ..... 315/149–159, 315/291, 297, 299, 307–309, 312; 345/76, 345/77, 87, 102
See application file for complete search history.

(56) References Cited

U.S. PATENT DOCUMENTS

| | | | | |
|---|---|---|---|---|
| 6,630,801 | B2 * | 10/2003 | Schuurmans | 315/307 |
| 2005/0035939 | A1 * | 2/2005 | Akiyama | 345/102 |
| 2005/0280375 | A1 * | 12/2005 | Chikugawa et al. | 315/291 |
| 2006/0221047 | A1 * | 10/2006 | Tanizoe et al. | 345/102 |
| 2007/0285378 | A1 * | 12/2007 | Lankhorst et al. | 345/102 |
| 2008/0103714 | A1 * | 5/2008 | Aldrich et al. | 702/81 |
| 2009/0033612 | A1 * | 2/2009 | Roberts et al. | 345/102 |

FOREIGN PATENT DOCUMENTS

| | | |
|---|---|---|
| CN | 1406450 | 3/2003 |
| CN | 1460393 | 12/2003 |
| CN | 1668158 | 9/2005 |
| CN | 1955795 | 5/2007 |
| CN | 101467490 | 6/2009 |

OTHER PUBLICATIONS

Chinese First Examination Report of China Application No. 200710178007.2, dated on Oct. 8, 2010.

* cited by examiner

*Primary Examiner* — Tung X Le
(74) *Attorney, Agent, or Firm* — Ladas & Parry LLP

(57) ABSTRACT

Disclosed herein are embodiments of color management systems and methods for LED backlights. One exemplary system comprises: a collection device adapted to collect optical signals of the LED array, transform the optical signals into electric signals and send the electric signals; a control device connected with the collection device adapted to process the electric signals, compare processing results with calibration values and output brightness control signals according to comparison results; and a driver device connected with the control device adapted to adjust brightness of the LED array according to the brightness control signals. Embodiments of the disclosed technology can be used to effectively adjust the brightness of LED backlights and/or keep the color coordinate values of the backlights constant in order to help ensure display quality.

4 Claims, 2 Drawing Sheets

COLOR MANAGEMENT SYSTEM AND METHOD FOR LED BACKLIGHTS

CROSS REFERENCE TO RELATED APPLICATION

This application claims priority to Chinese Patent Application No. 200710178007.2, filed on Nov. 23, 2007, entitled "Color Management System and Method for LED Backlights," which is incorporated herein by reference in its entirety.

FIELD

The disclosed technology relates to a control system for backlights, particular to a color management system and method for LED backlights.

BACKGROUND

As a new type of energy-saving and environmentally-friendly light source, a light emitting diode (LED) has many advantages, such as its small size, fast response time and long service life. LCD TVs can achieve higher contrast ratios, higher brightness levels and higher color saturations by using LEDs as backlights. Additionally, the LED is a semiconductor solid light source which does not contain any toxic substances. The LED light source is gradually replacing traditional backlights as an environmentally-friendly light source.

However, the LED itself does have some shortcomings. For example, the forward I-V characteristics of an LED are very steep because an LED typically has very small forward dynamic resistance. When the voltage between both ends of an LED has a slight change, the current flowing through the LED will change greatly. As a current-driven component, the brightness of an LED will vary with changes in current. Even if the current is constant, the brightness of an LED can also drift when the temperature rises. Changes in the brightness of an LED will bring about changes in its color. All of these issues affect the performance of LEDs as backlights and may negatively impact picture quality.

SUMMARY

Disclosed herein are embodiments of color management systems and methods for addressing variations in LED array brightness that are caused by changes in current and/or temperature and that may impact color quality.

In one exemplary embodiment, a color management system for LED backlights connected with an LED array is disclosed. The color management system of this embodiment comprises:

a collection device adapted to collect optical signals of the LED array, transform the optical signals into electric signals and send the electric signals;

a control device connected with the collection device, and adapted to process the electric signals, compare processing results with calibration values and output brightness control signals according to comparison results; and a driver device connected with the control device and adapted to output brightness adjustment currents for adjusting brightness of the LED array according to the brightness control signals.

In one particular embodiment, the control device comprises:

a control module connected with the collection device and the driver device, and adapted to process the electric signals received, compare the processing results with the calibration values, compute the comparison results and output the brightness control signals according to computing results; and a Micro Control Unit connected with the control module, and adapted to control work status of the control module and control communication between the control module and the driver device as well as the control module and the collection device.

In one particular embodiment, the collection device comprises at least one optical sensor.

The LED array can consist of a plurality of red, green and blue LEDs.

In another exemplary embodiment, a color management method for LED backlights is disclosed that comprises:

processing light intensity signals received, comparing processing results and calibration values, generating and outputting brightness control signals according to comparison results; and outputting brightness adjustment currents according to the brightness control signals so as to adjust brightness of the LED array.

The steps of processing light intensity signals received, comparing processing results and calibration values, generating and outputting brightness control signals according to comparison results can comprise:

collecting optical signals of the LED array;

transforming the optical signals into electric signals and sending the electric signals;

processing the electric signals and comparing the processing results and the calibration values;

getting voltage adjustment values of the LED array according to the comparison results and sending the voltage adjustment values; and generating brightness control signals according to the voltage adjustment values and sending the brightness control signals.

In view of the problem that the brightness of an LED array varies with changes in current and/or temperature (potentially impacting color quality), embodiments of the disclosed technology provide a color management system and method for LED backlights. By collecting light intensity signals of the LED array, transforming them into electric signals, adjusting drive currents of the LED array according to comparison results of voltage values corresponding to electric signals with calibration values to keep the brightness and color of the LED array unchanged, embodiments of the disclosed technology can control color coordinate values of the LED backlights so that they are kept constant, thereby improving display quality.

The disclosed technology will be described in more detail with reference to the drawings and embodiments.

The foregoing and other objects, features, and advantages of the disclosed technology will become more apparent from the following detailed description, which proceeds with reference to the accompanying figures.

DETAILED DESCRIPTION

Figure 1:
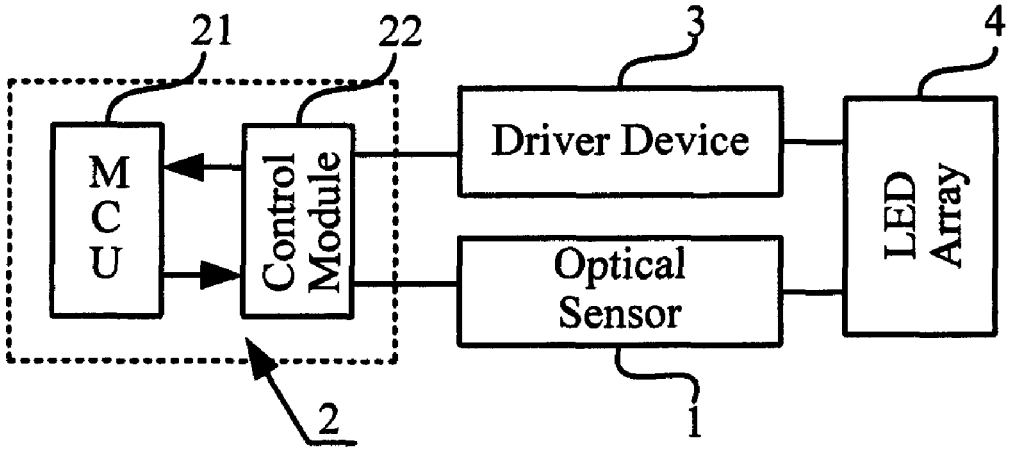
FIG. 1 is a structural schematic view of the color management system for LED backlights in accordance with an exemplary embodiment of the disclosed technology.

FIG. 1 is a structural schematic view of the color management system for an LED array in accordance with one exemplary embodiment of the disclosed technology. The illustrated embodiment comprises an optical sensor 1 as a collection device, a control device 2 and a driver device 3. At least one optical sensor 1 is adopted to collect light intensity signals of the LED array 4 and transform the collected light intensity signals into voltage signals corresponding to light intensity of red, green and blue. The voltage signals are output to the control device 2. The control device 2 is connected with the optical sensor 1, which is adapted to receive voltage signals from the optical sensor 1, process the voltage signals, compare processing results with calibration values and output brightness control signals according to comparison results. The driver device 3 is connected with the control device 2 and the LED array 4, which is adapted to output brightness adjustment currents according to the brightness control signals and adjust the brightness of the LED array 4 by the brightness adjustment currents.

In view of the problem in the prior art that the brightness of an LED array varies with changes in current and/or temperature (potentially impacting color quality), embodiments of the disclosed technology provide a device and a method for adjusting the brightness of LED array. The aim of adjusting the brightness of LED array is achieved by processing the collected light intensity signals, comparing them with the calibration values, outputting brightness control signals according to the comparison results and adjusting the current flowing through the LED array. Embodiments of the disclosed technology can control the LED color coordinates so that they are kept constant, thereby improving display quality.

Furthermore, the illustrated control device 2 comprises a Micro Control Unit 21 and a control module 22. The Micro Control Unit 21 is connected with the control module 22. The Micro Control Unit 21 is adapted to control communication between the control module 22 and the driver device 3 as well as the control module 22 and the optical sensor 1 to complete the calibration for parameters and the control for the work status of the control module 22. The control module 22 is adapted to store the calibration values of parameters, receive voltage signals from the optical sensor 1, process the voltage signals and output the brightness control signals to the driver device 3 according to the processing results.

In one particular embodiment, the calibration values stored in the control module 22 are the coordinate values of white points in the LED array under a preset normal situation and are the maximum brightness values which red LED, green LED and blue LED in the LED array can achieve.

In one exemplary embodiment, the optical sensor 1 collects the light intensity signals of the LED array 4 in a given frequency, transforms the light intensity signals into voltage signals corresponding to light intensity of red, green, and blue, and then sends the voltage signals to the control device 2. The control module 22 of the control device 2 receives the voltage signals, processes the voltage signals, computes coordinate values of the white points in the color coordinate corresponding to the lights collected by the optical sensor 1 by using a matrix transformation, compares the coordinate values with the calibration values of the coordinate values of the white points stored in the control module 22 to get comparison deviations and outputs different voltage adjustment values to the driver device 3 according to different comparison deviations. For example, if the color coordinate values computed are red-biased comparing when compared with the calibration values, this indicates that the brightness of the red LEDs in the LED array 4 has gotten strong. If the color coordinate values need to be kept unchanged, the currents of the red LEDs should be decreased. The control module 22 computes the comparison deviations according to inner algorithms so as to get voltage adjustment values and outputs the voltage adjustment values to the driver device 3. The driver device 3 takes the voltage adjustment values as duty factors to generate the corresponding brightness adjustment signals. For example, if the voltage adjustment value is 80, the driver device 3 can generate a brightness adjustment signal with a duty factor of 80% (e.g., the high level takes 80% of the brightness adjustment signal and the low level takes 20%). The brightness adjustment signal generates a corresponding brightness adjustment current which is output to the LED array 4. The LED array 4 adjusts the brightness of LEDs with corresponding colors according to the brightness adjustment current so as to achieve the aim of adjusting the color coordinate values of LED backlights and further achieve the aim of adjusting the color of the LED array 4.

Embodiments of the disclosed technology can perform timely and effective adjustment to the brightness of LED backlights to keep the color coordinate values constant and improve the color quality of pictures.

Figure 2:
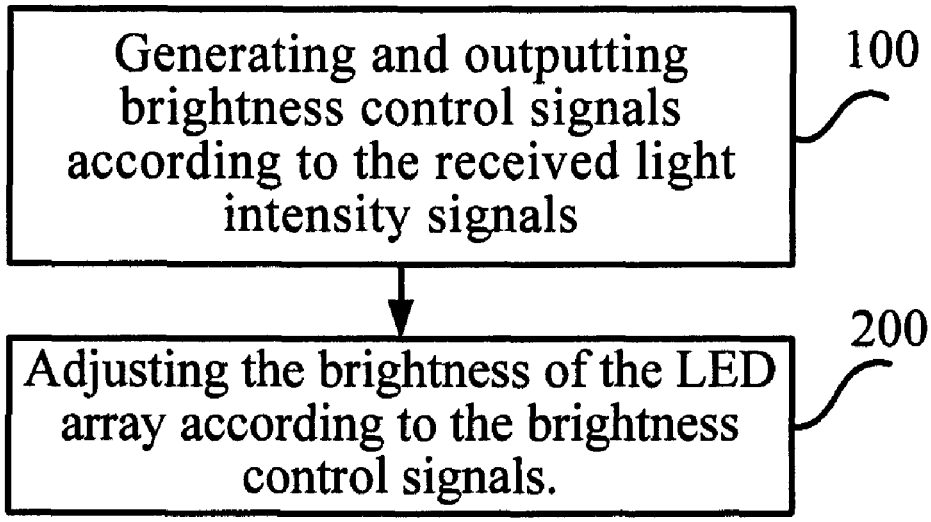
FIG. 2 is a flow chart of the color management method for LED backlights in accordance with an exemplary embodiment of the disclosed technology.

FIG. 2 is a flow chart of the color management method for LED backlights in accordance with one exemplary embodiment of the disclosed technology and comprises the following steps:

Step 100 is to generate and output brightness control signals according to the received light intensity signals; and Step 200 is to adjust the brightness of the LED array according to the brightness control signals.

Figure 3:
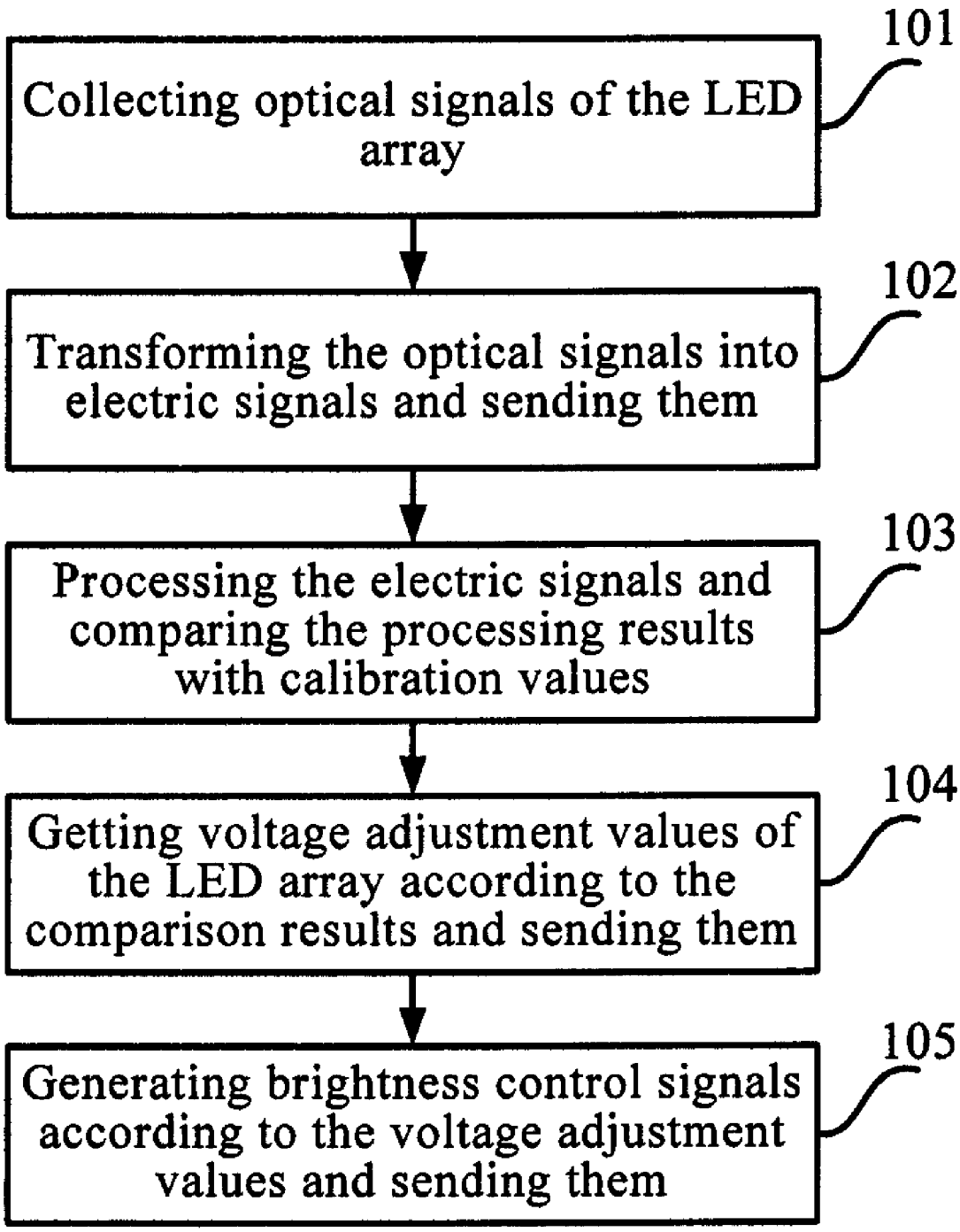
FIG. 3 is a flow chart of generating the brightness control signals in accordance with an exemplary embodiment of the disclosed technology.

FIG. 3 is a flow chart for generating the brightness control signals in accordance with one exemplary embodiment of the disclosed technology and comprises the following steps:

Step 101 is to collect optical signals of the LED array;

Step 102 is to transform the optical signals into electric signals and send them;

Step 103 is to process the electric signals and compare the processing results with calibration values;

Step 104 is to get voltage adjustment values of the LED array according to the comparison results and send them; and Step 105 is to generate brightness control signals according to the voltage adjustment values and send them.

In one exemplary embodiment, the light intensity signals of the LED array are collected at a given frequency. The light intensity signals are transformed into the voltage signals corresponding to light intensity of colors of red, green and blue. The voltage signals are processed. The coordinate values of the white points in the color coordinate corresponding to the lights collected by the optical sensor 1 are computed by using matrix transformation. The coordinate values are compared with the stored calibration values of the coordinate values of the white points to obtain comparison deviations. Different voltage adjustment values are output according to different comparison deviations. For example, if the color coordinate values computed are red-biased when compared with the calibration values, this indicates that the brightness of the red LEDs in the LED array 4 has gotten strong. If the color coordinate values need to be kept unchanged, the currents of red LEDs should be decreased. The comparison deviations are computed according to inner algorithms so as to get voltage adjustment values. The voltage adjustment values are taken as duty factors to generate the corresponding brightness adjustment signals. For example, if the voltage adjustment value is 80, driver device 3 can generate a brightness adjustment signal with a duty factor of 80% (e.g., the high level takes 80% of the brightness adjustment signal and the low level takes 20%). The brightness adjustment signal generates a corresponding brightness adjustment current which is output to the LED array. The LED array adjusts the brightness of LEDs with corresponding colors according to the brightness adjustment current so as to achieve the aim of adjusting the color coordinate values of LED backlights and further achieve the aim of adjusting the color of the LED array.

In one embodiment, the calibration values stored are the coordinate values of white points in the LED array under a preset normal situation and are the maximum brightness values that the red LEDs, green LEDs and blue LEDs in the LED array can achieve.

Embodiments of the disclosed technology can perform timely and effective adjustment to the brightness of LED backlights to keep the color coordinate values constant and improve color quality.

Having illustrated and described the principles of the disclosed technology, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only preferred examples of the technologies and should not be taken as limiting the scope of the invention. Rather, the scope of the invention is defined by the following claims and their equivalents. We therefore claim all that comes within the scope and spirit of these claims.

We claim:

1. A color management system for light emitting diode (LED) backlights, connected with an LED array, comprising:

a collection device adapted to collect optical signals of the LED array, transform the optical signals into electric signals and send the electric signals;

a control device connected with the collection device, and adapted to process the electric signals to get coordinate values of white points in a color coordinate, compare the coordinate values of the white points with calibration values of the coordinate values of the white points and output brightness control signals according to comparison results, wherein the control device comprises:

a control module connected with the collection device and the driver device, and adapted to process the electric signals received to get the coordinate values of the white points in the color coordinate, compare the coordinate values of the white points with the calibration values of the coordinate values of the white points, compute the comparison results and output the brightness control signals according to computing results; and a micro control unit connected with the control module, and adapted to control work status of the control module, control communication between the control module and the driver device, and control communication between the control module and the collection device; and a driver device connected with the control device and adapted to output brightness adjustment currents for adjusting brightness of the LED array according to the brightness control signals.

2. The system according to claim 1, wherein the collection device comprises at least one optical sensor.

3. The system according to claim 1, wherein the LED array consists of a plurality of red, green and blue LEDs.

4. A color management method for light emitting diode (LED) backlights, comprising:

processing light intensity signals received to get the coordinate values of white points in a color coordinate, comparing the coordinate values of the white points and calibration values of the coordinate values of the white points, generating and outputting brightness control signals according to comparison results, and wherein the step of processing light intensity signals received comprises:

collecting optical signals of the LED array;

transforming the optical signals into electric signals and sending the electric signals;

processing the electric signals to get the coordinate values of the white points in the color coordinate, and comparing the coordinate values of the white points and the calibration values of the coordinate values of the white points;

getting voltage adjustment values of the LED array according to the comparison results and sending the voltage adjustment values; and generating brightness control signals according to the voltage adjustment values and sending the brightness control signals; and outputting brightness adjustment currents according to the brightness control signals such that adjust brightness of an LED array is adjusted.

* * * * *